US006615511B2

(12) United States Patent
Augscheller et al.

(10) Patent No.: US 6,615,511 B2
(45) Date of Patent: Sep. 9, 2003

(54) PROCESS FOR MONITORING WEB BREAKS

(75) Inventors: Thomas Augscheller, Bachhagel (DE); Roland Mayer, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/925,413

(22) Filed: Aug. 10, 2001

(65) Prior Publication Data

US 2002/0023369 A1 Feb. 28, 2002

(30) Foreign Application Priority Data

Aug. 28, 2000 (DE) ..... 100 42 243

(51) Int. Cl.[7] ..... F26B 3/00
(52) U.S. Cl. ..... 34/459; 34/452; 34/500
(58) Field of Search ..... 34/444–447, 452, 34/459, 498, 500, 507

(56) References Cited

U.S. PATENT DOCUMENTS 3,085,347 A 4/1963 Justus
5,651,511 A * 7/1997 Crowley et al. ..... 242/420.3
5,862,608 A * 1/1999 Kotitschke ..... 34/117
5,867,920 A * 2/1999 Rogne et al. ..... 34/267
5,887,358 A * 3/1999 Bischel et al. ..... 34/115
6,032,385 A * 3/2000 Bischel et al. ..... 34/456
6,067,726 A * 5/2000 Rogne et al. ..... 34/268
6,112,658 A * 9/2000 Gunther et al. ..... 101/171
6,294,050 B1 * 9/2001 Oechsle et al. ..... 162/207
6,365,004 B1 * 4/2002 Hamstrom et al. ..... 162/198
6,423,184 B2 * 7/2002 Vahatalo et al. ..... 162/198
6,463,170 B1 * 10/2002 Toivonen et al. ..... 382/141

FOREIGN PATENT DOCUMENTS

DE 19841768 3/2000
GB 857591 1/1961

* cited by examiner

*Primary Examiner*—Henry Bennett
*Assistant Examiner*—Andrea M. Ragonese
(74) *Attorney, Agent, or Firm*—Greenblum & Bernstein, P.L.C.

(57) ABSTRACT

Process and apparatus for monitoring web breaks in a machine for producing a material web includes at least one impingement dryer. The process includes guiding the material web through the at least one impingement dryer, and monitoring the material web for web breaks in at least one of a region, viewed in a web travel direction, before an intake into the at least one impingement dryer, after an exit from the at least one impingement dryer and within the at least one impingement dryer. The process further includes at least partially deactivating the at least one impingement dryer when a web break is detected.

33 Claims, 3 Drawing Sheets

PROCESS FOR MONITORING WEB BREAKS

CROSS-REFERENCE TO RELATED APPLICATIONS

The present application claims priority under 35 U.S.C. §119 of German Patent Application No. 100 42 243.8, filed on Aug. 28, 2000, the disclosure of which is expressly incorporated by reference herein in its entirety.

BACKGROUND OF THE INVENTION

1. Field of the Invention

The invention relates to a process for monitoring web breaks in a machine for producing a material web, in particular a paper or cardboard web. It further relates to a machine for producing a material web, in particular a paper or cardboard web, in which such a monitoring of web breaks is embodied.

2. Discussion of Background Information

In multi-cylinder drying sections commonly used up to now, the paper web is guided over several steam-heated cylinders or over an arrangement of several steam-heated cylinders and wire suction rolls in order to be dried; however, the use of at least one impingement dryer has been suggested for impinging the material web with a hot air and/or hot steam impingement (see, for example, DE 198 41 768.3).

Usually, in paper machines the detection of a web break occurs at several points in the machine running direction on the guidance side or drive side within the cylinder drying section. Such a web break detection is used to avoid an uncontrolled accumulation of paper in the drying section and a so-called wrapping of the cylinders. Each detection of a web break causes a striking off of the paper web and/or a raising of the pick-up roll.

One problem occurs when impingement dryers are used in that the drying wires may be damaged in the event of a web break.

SUMMARY OF THE INVENTION

The present invention provides a process and machine of the type mentioned at the outset which virtually eliminates the danger of such damage to the drying wire although several impingement dryers are used.

According to the invention, the process for monitoring for web breaks in a machine for producing a material web, in particular a paper or cardboard web, includes guiding the material web through at least one impingement dryer, monitoring the material web, viewed in a web travel direction, for web breaks in the region before the intake into the impingement dryer and/or in the region after the exit from the impingement dryer and/or within the impingement dryer, and at least partially deactivating the impingement dryer when a web break is detected.

In the exemplary embodiment, the material web is monitored for web breaks, viewed in the web travel direction, preferably directly before the intake into the impingement dryer and/or directly after the exit from the impingement dryer and/or between several impingement dryers.

In a preferred practical embodiment according to the invention, the material web is monitored for a web break at least essentially over the entire width. Such a width-wide monitoring can also detect when parts of the web are missing only so that even a sporadic overheating of the drying wires is avoided as well.

In certain cases, however, it may be sufficient to monitor the material web for web breaks only on one or both lateral web edges. Thus, a monitor of the web edges on the guidance side and the driving side is fundamentally conceivable as well.

Generally, each impingement dryer is provided with at least one impingement hood. When a web break is detected, preferably at least one of the impingement hoods is deactivated corresponding to the respective impingement dryer.

In order to deactivate a respective impingement dryer, this dryer is reversed from a normal operational state in which the material web is preferably impinged by a hot air impingement and/or a hot steam impingement to a web break operational state in which only the internal hot air and/or hot steam circulation occurs.

Alternatively or additionally, for the purpose of deactivating the impingement hood, the burner assigned to it can be reversed to minimum capacity.

Alternatively or additionally, it is possible for deactivating a respective impingement hood to transfer this hood away from the normal production line into a transfer line.

After a web break, the deactivation of the impingement dryer should occur within about 20 seconds, preferably within about 10 seconds so that, even at an air temperature of about 300–500° C., no overheating of the drying wires is caused.

According to a useful practical embodiment of the process according to the invention, when a web break is detected, in addition to the at least partial deactivation of the impingement dryer, at least one pick-up point is simultaneously opened as well, which is provided in the web travel direction before the impingement dryer and/or before and/or in the press section. This should occur within about 5 seconds, preferably less than about 2 seconds, after a web bread occurred.

Additionally, it is useful in certain cases for at least a partial deactivation of the impingement dryer to simultaneously cause the material web and/or paper web to be stricken off as well when a web break is detected.

According to a preferred practical embodiment, the material web is monitored for web breaks at least at one point by at least one sensor. Here, the use of most different types of sensors is conceivable. Advantageously, at least one optical sensor is used. In particular, a respective web break can be determined by color recognition or by image evaluation when a camera is used.

In certain cases, it is advantageous for at least one sensor to be directed to the material web, preferably directly after the respective impingement hood.

In the exemplary embodiment, the sensor can be directed towards the material web in a region in which the web is still positioned on a drying wire guided through the respective impingement dryer.

For example, it is also possible to direct the sensor to the material web in a region in which this web is positioned on the drying wire of a suctioned roll provided subsequent to the impingement dryer. This suctioned roll can be a suction roll or a so-called "DuoStabi-roll," for example.

The drying wires are preferably made from plastic with the maximum allowable temperature being between about 100 and 300° C. However, no damages should occur at temperatures between about 300 and 500° C. on the drying wires during the deactivation of the impingement dryer.

However, it is also conceivable, to direct the sensor to the material web in the region of the first drying cylinder subsequent to the impingement dryer, with the material web being exposed after passing a previous wire and prior to the intake into another wire, with the sensor being directed towards the web section exposed. Therefore, the sensor can be directed towards the first cylinder after the impingement dryer when a group change occurs at this cylinder, thus resulting in a position at which the paper web is exposed.

In certain cases it can also be advantageous for the material web to be monitored in the region of a suctioned roll following the impingement dryer or one of the large suctioned rolls of the impingement dryer by monitoring the vacuum of this suctioned roll. As soon as the roll is no longer covered by the material web, particularly a paper web, the vacuum reduces considerably. For example, the suctioned roll can be a suction roll or a so-called "DuoStabi-roll" as well. Here, the suctioned roll is preferably provided inside of the first cylinder group subsequent to the impingement dryer. In particular, it can be provided before a detachment doctor, viewed in the web travel direction. In particular, it can be a the first suctioned roll subsequent to the impingement dryer.

The suctioned rolls to be monitored can also be the large suction rolls on which the impingement hoods are mounted.

According to a preferred useful embodiment of the process according to the invention, the material web is monitored for web breaks in the area of the impingement dryer positioned between a press section and a cylinder drying section of a machine for producing a material web.

In certain cases, it can be also advantageous to monitor the material web for web breaks in the area of the impingement dryer provided inside of a cylinder drying section of a machine for producing a material web.

For example, the material web can be monitored for web breaks in the region of an impingement dryer with the material web being guided at least partially along at least one straight or slightly bent and/or at least one, in particular larger, support roll, preferably suctioned.

The instant invention is also directed to a machine for producing a material web, in particular a paper or cardboard web, with at least one impingement dryer through which the material web is guided, a device for monitoring the material web for web breaks, viewed in the web travel direction, in a region before an intake into the impingement dryer and/or in the region after the exit from the impingement dryer, and a device for at least partially deactivating the impingement dryer when a web break is detected.

The device monitoring web breaks preferably include at least one sensor in order to monitor the material web for web breaks at least at one point using at least one such sensor.

In a useful practical embodiment of the machine according to the invention, the device for monitoring for web breaks and/or the device for deactivation include at least one electronic control.

This invention is particularly suitable in machines in which the material web is guided through the press nip(s) in the press section together with a belt in the form of a pressing felt or a transfer belt on both sides.

This invention is recommended at high machine speeds of above about 1100 m/min as well.

The present invention is directed to a process for monitoring web breaks in a machine for producing a material web that includes at least one impingement dryer. The process includes guiding the material web through the at least one impingement dryer, monitoring the material web for web breaks in at least one of a region, viewed in a web travel direction, before an intake into the at least one impingement dryer, after an exit from the at least one impingement dryer and within the at least one impingement dryer, and at least partially deactivating the at least one impingement dryer when a web break is detected.

According to a feature of the instant invention, the material web can include one of a paper and cardboard web.

Further, the at least one impingement dryer can include a plurality of impingement dryers, and the monitoring for web breaks may occur at least one of before an intake into one of the plurality of impingement dryers, directly after the exit from the one of the plurality of impingement dryers, and between successively arranged impingement dryers.

In accordance with another feature of the invention, the monitoring for web breaks can occur at least essentially over an entire width of the material web.

The monitoring for web breaks can occur along at least one lateral edge of the material web. Further, monitoring for web breaks may occur only along one edge of the material web. Also, monitoring for web breaks can occur along both lateral edges of the material web.

Moreover, at least one impingement dryer may include at least one impingement hood, and, when a web break is detected, the at least one impingement hood can be deactivated. The deactivation of the at least one impingement hood may include reversing operational states of the at least one impingement hood from a normal operational state, in which the material web is impinged with at least one of hot air and hot steam, to a web break operational state, in which the material web is impinged with at least one of hood-internal hot air and hot steam impingement occur. In the web break operational state, the material web can be impinged with only at least one of hood-internal hot air and hot steam. Further, the deactivating of the at least one impingement hood can include switching a burner assigned to the at least one impingement hood to minimum capacity. Further still, the deactivating of the impingement hood can include transferring the hood from a normal web travel line into a web transfer position.

The deactivation of the at least one impingement dryer can occur within about 20 seconds after the web break. Further, the deactivation of the at least one impingement dryer occurs within about 10 seconds after the web break.

When a web break is detected, the process can further include opening at least one pickup point located before the impingement dryer.

Further, when a web break is detected, the process can further include opening at least one pickup point is located at least one of before and in a press section.

When a web break is detected, the process may further include simultaneously striking off the material web.

The monitoring of the material web for web breaks may include positioning a sensor at least at one point and detecting the passage of the material web with the at least one sensor.

The monitoring of the material web for web breaks can include at least one of monitoring the material web with at least one optical sensor and at least one camera. Further, the web break may be detected by color recognition. Also, the web break can be detected by image evaluation.

Moreover, the at least one impingement dryer can include at least one impingement hood, and at least one sensor can be directed toward the material web at a location directly after the at least one impingement hood. A drying wire can be arranged to guide the material web through the at least one impingement dryer, and the at least one sensor can be directed toward a region of the material web which is positioned on the drying wire. Further, a drying wire may be arranged to guide the material web through the at least one impingement dryer and over a suctioned roll positioned after the at least one impingement dryer, and the at least one sensor can be directed toward a region of the material web which is positioned on the drying wire where it is guided over the suctioned roll. The machine can include a first drying wire and a second drying wire, and a drying cylinder can be arranged after the at least one impingement dryer to transfer the material web from the first drying wire to the second drying wire, and the at least one sensor may be directed toward a location where the material web is supported by the drying cylinder and between the first and second drying wires.

The at least one impingement dryer can include a suctioned roll and a suction roll can be arranged after the at least one impingement dryer, and the web breaks may be monitored by monitoring a vacuum of at least one of the suctioned roll and the suction roll. The suction roll can be located in of a first cylinder group located after the at least one impingement dryer. The suction roll can be located before a detachment doctor.

According to still another feature of the invention, the machine may include a press section and a cylinder drying section, and the monitoring for web breaks can occur in a region of the at least one impingement dryer positioned between the press section and the cylinder drying section.

In accordance with a further feature of the present invention, the machine may include a cylinder drying section, and the monitoring for web breaks can occur in a region of the at least one impingement dryer located in the cylinder drying section.

The at least one impingement dryer may include a guide path, which is at least one of a straight and slightly bent, on which the material web is at least partially guided, and the monitoring for web breaks can occur in a region of the at least one impingement dryer. The machine may include another impingement dryer including a suctioned support roll, and the monitoring for web breaks can further occur in a region of the suctioned support roll.

The machine can include another impingement dryer including a suctioned support roll, and the monitoring for web breaks can occur in a region of the suctioned support roll.

The present invention is directed to an apparatus for producing a material web. The apparatus includes at least one impingement dryer arranged so that the material web is guided through the at least one impingement dryer, monitoring device positioned to detect web breaks of the material web, the monitoring device being positioned in a region at least one of before an intake into the at least one impingement dryer, after an exit from the at least one impingement dryer, and within the at least one impingement dryer, and deactivating device arranged to at least partially deactivate the at least one impingement dryer when a web break is detected.

According to a feature of the invention, the material web can include one of a paper and cardboard web.

The at least one impingement dryer can include a plurality of impingement dryers, and the monitoring device may be positioned at least one of directly before an intake into one of the plurality of impingement dryers, directly after an exit from the one impingement dryer, and between successively arranged impingement dryers.

The monitoring device can be structured to detect web breaks at least essentially over an entire width of the material web.

Further, the monitoring device can be structured to detect web breaks along at least one lateral edge of the material web. The monitoring device may be structured to detect web breaks along only one lateral edge of the material web. The monitoring device can be structured to detect web breaks along both lateral edges of the material web.

Moreover, the at least one impingement dryer can include at least one impingement hood, which is structured to be deactivated upon detection of a web break. The at least one impingement hood can be structured to be reversible from a normal operational state, in which the material web is impinged by at least one of hot air and hot steam, to a web break operational state, in which the material web is impinged with at least one hot air and/or hot steam contained within the hood. Further, the at least one impingement hood can include a burner structured to be switchable to a minimum capacity when a web break.

The at least one impingement hood may be structured to be movable between a normal web travel line and a web transfer position.

Further, the apparatus can include an openable pick-up point located before the at least one impingement dryer, the openable pick-up point may be structured to open upon detection of a web break.

The apparatus can also include a device for striking off the material web upon detection of a web break.

In accordance with another feature of the instant invention, the monitoring device may include at least one sensor arranged to monitor the material web for web breaks.

According to still another feature of the invention, the monitoring device can include at least one of at least one optical sensor and at least one camera.

In accordance with a further feature of the present invention, the monitoring device may detect web breaks by at least one of color recognition and image analysis.

According to the invention, the at least one impingement dryer can include at least one impingement hood, and the monitoring device can include at least one sensor directed toward the material web subsequent to respective the at least one impingement hood. A drying wire may be arranged to guide the material web through the at least one impingement dryer. The monitoring device can include at least one sensor directed toward a location where material web it supported by the drying wire. Further, a drying wire and a suctioned roll can be arranged subsequent to the at least one impingement dryer. The at least one sensor can be directed toward a location where the material web is supported on the drying wire and on the suctioned roll. A drying wire can be arranged to guide the material web through the at least one impingement dryer, and the drying wire can be made of plastic with a maximum allowed temperature between about 100° C. and 200° C. Moreover, a first drying wire and a second drying wire, and a drying cylinder arranged after the at least one impingement dryer can be provided to transfer the material web from the first drying wire to the second drying wire. The at least one sensor can be directed toward a location where the material web is supported by the drying cylinder and between the first and second drying wires.

A suctioned roll can be positioned subsequent to the at least one impingement dryer. The monitored device can monitor a vacuum of the suctioned roll. The suctioned roll can be located inside a first cylinder group subsequent to the at least one impingement dryer. Further, the suctioned roll may be located before a detachment doctor.

According to a still further feature of the invention, the apparatus can include a press section and a cylinder drying section. The at least one impingement dryer can be located between the press section and the cylinder drying section, and the material web may be monitored for web breaks in a region of the at least one impingement dryer. The material web can be monitored for web breaks in a region of the at least one impingement dryer located within the cylinder drying section.

In accordance with another feature of the present invention, the at least one impingement dryer can include a guide path, which is at least one of a straight and slightly bent, on which the material web is at least partially guided, and web breaks may be monitored in a region of the at least one impingement dryer. Further, another impingement dryer can be provided that includes a suctioned support roll, and web breaks may be also monitored in a region of the suctioned support roll.

Further, another impingement dryer can be included that has a suctioned support roll, and web breaks can be monitored in a region of the suctioned support roll.

At least one of the monitoring device and the deactivation device can include at least one electronic control.

In accordance with still yet another feature of the present invention, two belts may be arranged to form a press nip, through which the material web is guided. Each of the two belts can be formed by one of a press felt and transfer belt.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
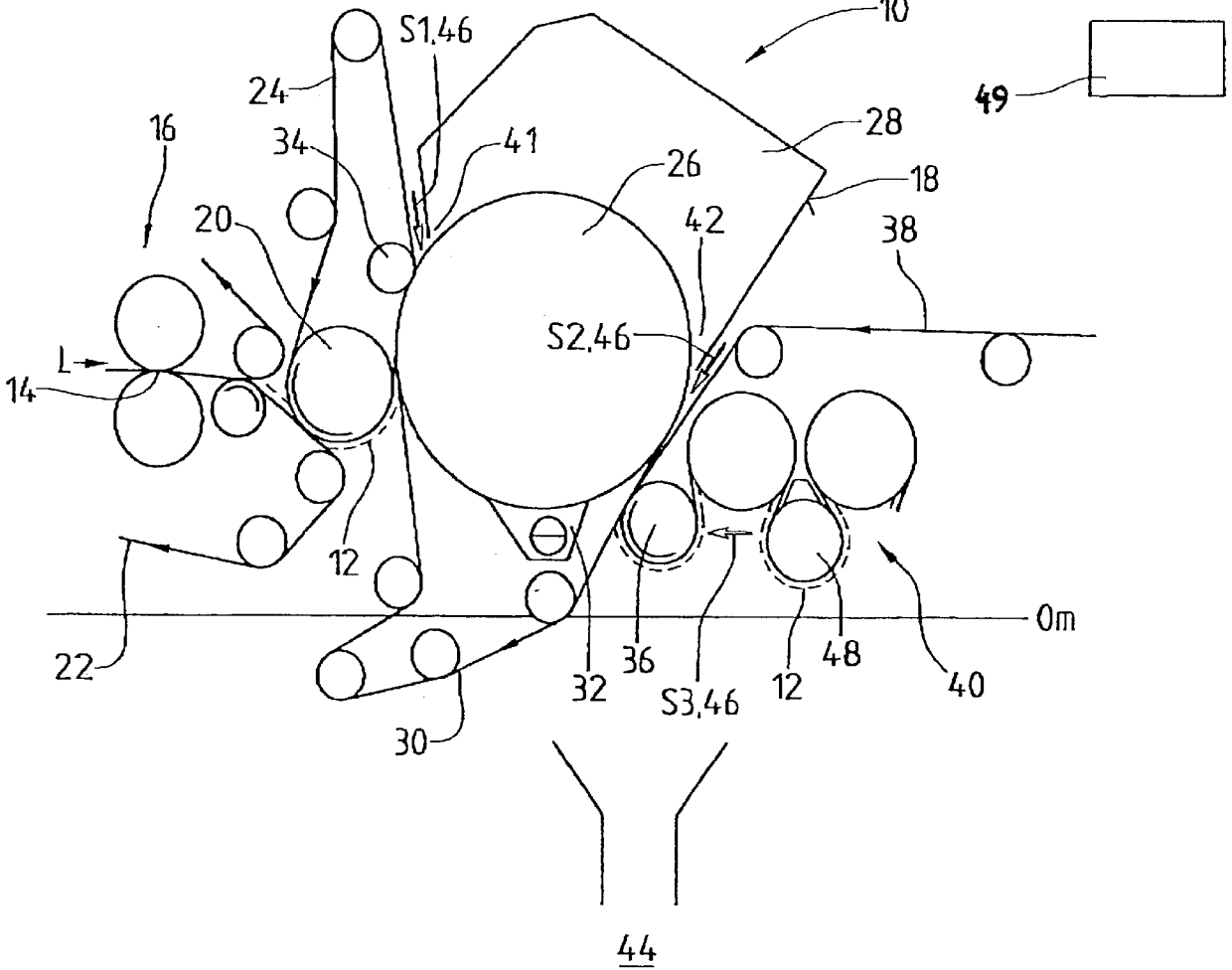
FIG. 1 schematically illustrates an exemplary embodiment of a drying section according to the instant invention having only one impingement dryer.

FIG. 1 shows a purely schematic drawing of a drying section 10 of a machine for producing a material web 12 which can be, in particular, a paper or a cardboard web.

A larger pickup suction roll 20 is provided between the last press nip 14 of a press section 16 and a subsequent impingement dryer 18, transferring the material web 12 from the pressing felt 22, guided through the last pressing nip 14, immediately to the impingement dryer 18.

In the present case, the pickup suction roll 20 is wrapped by a wire 24.

The impingement dryer 18 includes an impingement hood 28, in one piece in the present case, assigned to a larger support roll 26. The material web 12 is transferred to the support roll 26 of this impingement drying unit by means of the pickup suction roll 20.

In the present case, the support roll 26 is wrapped by a wire 30 and formed by a suction roll, assigned here to an exterior suction box 32.

The acceptance of the material web 12 by the large support roll 26 is aided by a deflection roll 34 provided inside of the loop of the wire 24 positioned at a distance in the web travel direction L downstream of the pickup suction roll 20. Subsequent to this deflection roll 34 contacting the support roll 26, the wire 24, and thus the material web 12, contact the support roll 26 in the region between the pickup suction roll 20 and the deflection roll 34.

Subsequent to the support roll 26, the material web 12 is accepted by a wire 38 of a first multi-cylinder group 40 of several drying cylinders 48 in the region of a suction roll 36. Here, the transfer occurs such that, in the case of paper tearing off in between the wires 30 and 38, it can fall into the cellar 44.

Viewed in the web travel direction L, in the drying section 10 the material web 12 is monitored for web breaks in the region before the intake 41 into the impingement dryer 18 and/or in the region after the exit 42 from the impingement dryer 18 in order to at least partially deactivate the impingement dryer 18 when a web break is detected.

Here, viewed in the web travel direction L, the material web 12 can be monitored for web breaks directly before the intake 41 into the impingement dryer 18 and/or directly after the exit 42 out of the impingement dryer 18. In FIG. 1, the corresponding monitoring points are marked S1 and S2 respectively.

As is discernible from FIG. 1, additionally or alternatively, a corresponding monitoring of web breaks can occur in the region of the first suctioned roll subsequent to the impingement dryer 18, here the suction roll 36. The corresponding monitoring point is marked S3.

The material web 12 can at least essentially be monitored for web breaks over the entire width at the respective monitoring point S1–S3. Fundamentally, however, monitoring of web breaks is possible on one or both lateral web edges as well.

In the present case, when a web break has been detected, the impingement hood 28 corresponding to the impingement dryer 18 is deactivated. For this purpose, the impingement hood can be reversed, particularly from a normal operational state in which the material web 12 is impinged with hot air and/or hot steam impingement into a web break operational state with only hood-internal hot air and/or hot steam occurring.

Alternatively or additionally, a burner assigned to the impingement hood 28 can be reversed in order to deactivate this hood. Here, for example, this burner can be completely switched off as well.

Alternatively or additionally, the impingement hood 28 can be transferred for deactivation from the normal web travel line, i.e., here away from the support roll 26 into a web transfer position.

When a web break is detected, in addition to an at least partial deactivation of the impingement dryer, a material web strike off and/or paper strike off can, in particular, be initiated substantially simultaneously. Basically, it is also possible, to open at least one pickup point provided in the web travel direction L before the impingement dryer 18 simultaneously with the at least partial deactivation of the impingement dryer 18.

At least at one point S1–S3, the material web 12 can be monitored for web breaks by at least one sensor 46. Here, for example, at least one optical sensor may be used.

Here, it is possible to detect a respective web break, for example, by color recognition, in particular.

A respective sensor can be directed directly toward the material web 12, for example, both at the monitoring point S1 provided before the impingement hood 28 and at the monitoring point S2 immediately subsequent to the impingement hood 28. Here, the respective sensor 46 is directed towards the region of the material web 12 in which the web is positioned already or still on the drying wire 30 guided through the impingement dryer 18.

A respective sensor 46 can be directed towards the material web 12 at the monitoring point S3 as well. In this case, the material web 12 is positioned on the drying wire 38 of the first suctioned roll, here the suction roll 36, provided subsequently to the impingement dryer 18.

Fundamentally, it is also possible to monitor the material web 12 at a monitoring point S3 by monitoring the vacuum of the suctioned roll, here the suction roll 36.

The device for monitoring web breaks comprises the sensors 46 and/or the vacuum monitoring device and/or the deactivation device, as well as at least one electronic control 49.

In the present case, the material web 12 is monitored for web breaks in the region of the impingement dryer 18 which is provided between the press section 16 and the multi-cylinder group or cylinder drying section 40 of the machine for producing the material web 12.

Fundamentally, however, each monitoring of web breaks can occur on a suctioned roll provided inside of the first cylinder group 40 subsequent to the impingement dryer 18 as well. Thus, for example, a corresponding monitoring of web breaks is possible at a roll 48 provided as a suctioned roll.

The suctioned roll in question can be provided before a detachment doctor in the web travel direction.

Furthermore, it is generally possible to monitor the material web 12 for web breaks in the region of an impingement dryer provided inside of a cylinder drying section 40 of a machine for producing the material web 12.

The embodiment according to FIG. 2 differs from the above-described embodiments essentially in that, in addition to the impingement dryer 18 provided subsequently to the last press nip 14, another impingement dryer 18' follows.

This second impingement dryer 18' includes a two-part impingement hood 28' assigned to a larger support roll 26'. In this case as well, the support roll 26' is formed by a suction roll assigned to an exterior suction box 32', for example. In the present case, the diameter of the two support rolls 26, 26' are at least essentially of the same size. The second support roll 26' is wrapped by a first wire 38 of the cylinder drying section 40.

Figure 2:
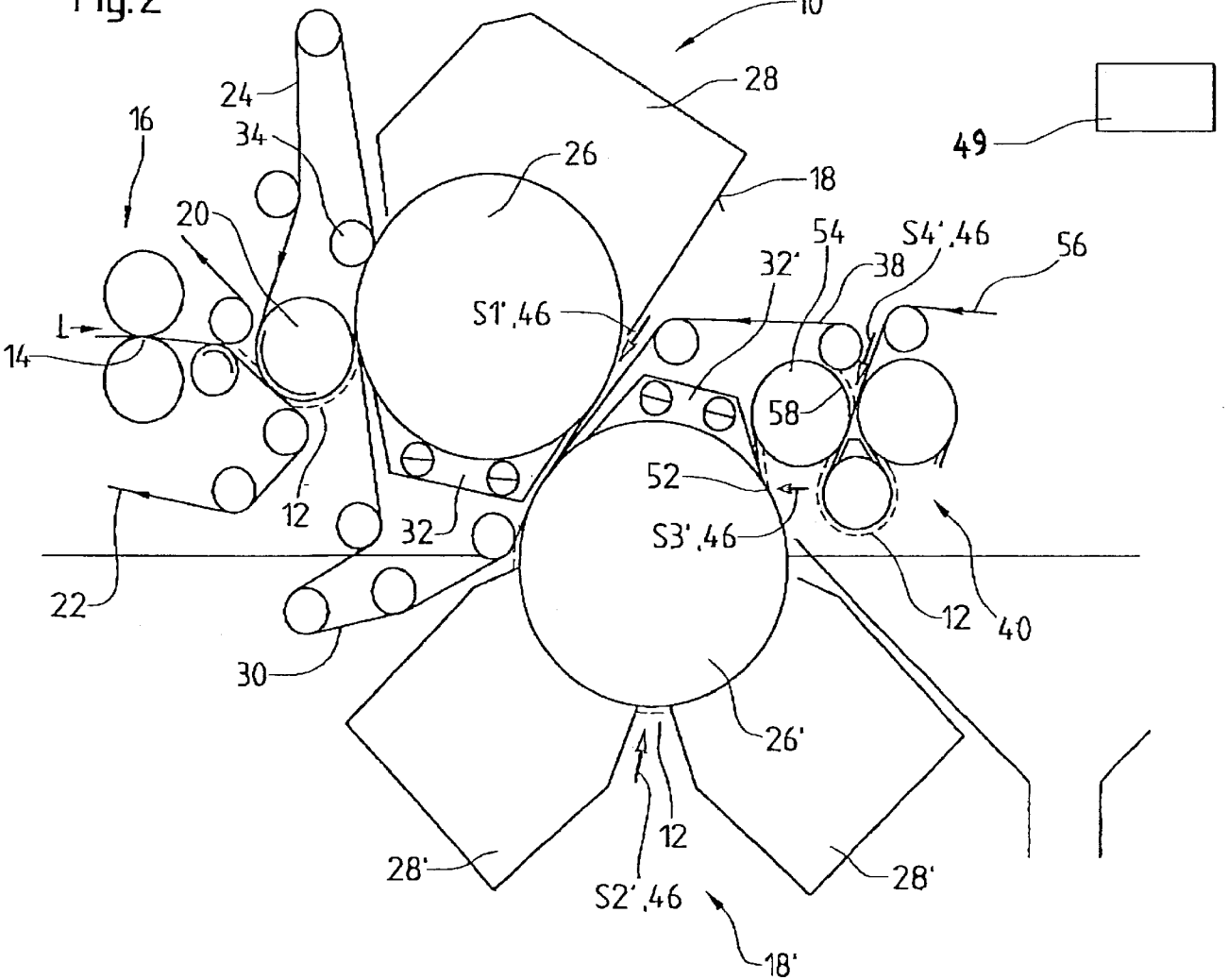
FIG. 2 schematically illustrates another embodiment of the drying section of the instant invention which includes two impingement dryers.

As is discernible from FIG. 2, the material web 12 is immediately transferred from the wire 30 of the first impingement dryer 18 to the large support roll 26' of the subsequent second impingement dryer 18' wrapped by the wire 38.

The large support roll 26' is provided diagonally below the large support roll 26. While the impingement hood 28 of the first impingement dryer 18 is generally provided above the corresponding support roll 26, the impingement hood 28', comprising two parts here, of the subsequent second impingement dryer 18' is generally arranged below the corresponding large support roll 26. Thus, different sides of the web are impinged by the two impingement hoods 28, 28'.

As is discernible from FIG. 2, a monitoring of web breaks is possible at a point S1', for example, immediately subsequently to the first impingement hood 18. Alternatively or additionally, a monitoring of web breaks is possible at a point S2' immediately following the impingement hood 28' of the two-part impingement dryer 18'. Therefore, the monitoring of web breaks occurs here between the two impingement hoods 28' corresponding to the support roll 26.

Alternatively or additionally, a monitoring of web breaks is conceivable at a point S3' in the region of the run-off 52 of the wire 38 from the support roll 26'.

At the monitoring point S2', a respective sensor 46 can be directed towards the material web 12 guided over the support roll 26' together with the wire 38.

At the monitoring point S3', a respective sensor 46 can be directed towards the material web 26 still positioned on the wire 38 running off the support roll 26.

At the monitoring point S4', the respective sensor can be directed towards the material web 12 in the region of the first of the impingement dryers 18' subsequent to the drying cylinders 54 in the described manner, in which the material web is exposed after having run off the previous wire 38 and prior to the intake of the new wire 56, with the sensor 46 being directed towards the web point 58 exposed.

Additionally, the embodiment according to FIG. 2 comprises at least essentially the same configuration as the one shown in FIG. 1, with identical reference characters being assigned to corresponding parts. The respective monitoring of web breaks can again occur at the respective points in the manner, for example, described using the embodiment according to FIG. 1.

Figure 3:
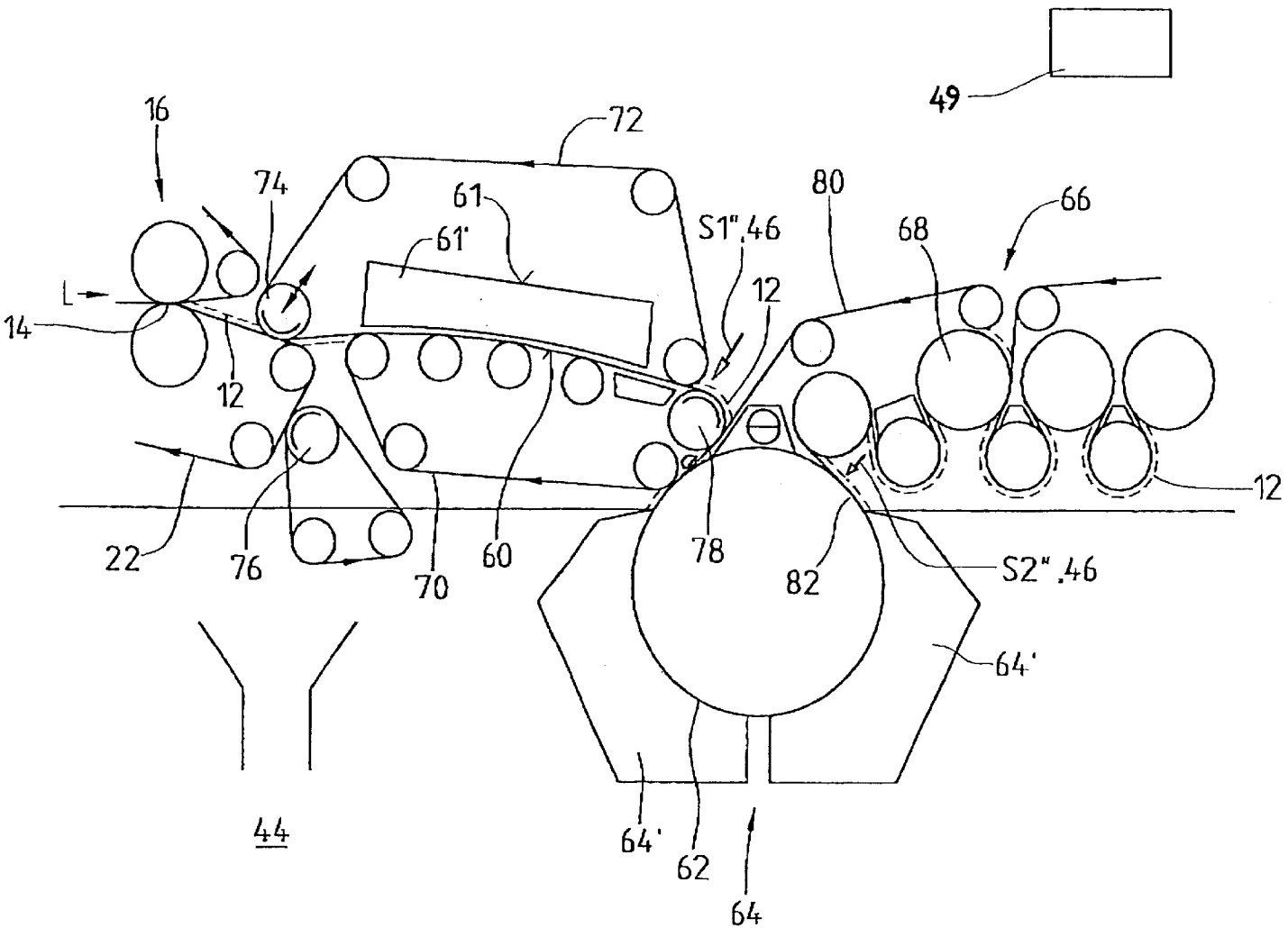
FIG. 3 schematically illustrates still another embodiment of the drying section of the instant invention which includes a straight or slightly bent impingement drying line and a larger lower support roll having a corresponding impingement dryer.

In the embodiment according to FIG. 3, the material web 12 is guided, in a closed draw originating from the last press nip 14 of the press section 16, over at least one straight or slightly bent line 60 to a support roll 62, particularly a larger support roll, with a corresponding impingement dryer 64, by which the material web 12, guided over the support roll 62, is impinged with hot air impingement and/or hot steam impingement with the line 60, straight or slightly bent, being provided as an impingement drying line and/or transfer foil line with a corresponding impingement dryer 61. The impingement dryer 61 may be provided with at least one impingement hood 61', for example. The impingement dryer 64 has a two-part impingement hood 64' as well.

FIG. 3 shows an exemplary embodiment having a lower, larger support roll 62 with impingement dryer 64 assigned thereto connected to the straight or slightly bent line 60 provided. Here, the support roll 62 is provided before a dryer group 66 with at least one drying cylinder 68.

The material web 12 is guided between two wires 70, 72 in the straight or slightly bent line 60. Here, the material web 12 is impinged with an impingement from above by the impingement dryer 61 through the corresponding wire 72, for example. This impingement dryer 61 can also be respectively deactivated when a web break is detected, and can be provided with at least one impingement hood 61'.

The material web 12 is transferred by a pickup roll 74 from the lower press felt 22, guided through the press nip 14, to the wire 72. In the region of an additional pickup roll 76, the material web 12 can be moved to the cellar 44, by which the material web 12 can be taken off the press felt or press belt 22.

The wire 70 of the impingement dryer and/or transfer foil line 60 is guided over a smaller suction roll 78 before the larger support roll 62. A part of such a smaller suction roll can be embodied as a pressured air zone, or a pressured air box may be installed in the open space in order to separate the material web 12 from the previous wire, here the wire 70.

The material web 12 is transferred from the wire 70 of the straight or slightly bent impingement dryer line or transfer foil line 60 to a wire 80 guided over a subsequent larger support roll 62 and a vacuum can be provided for the transfer region, for example, by means of a suction box provided before or on the support roll 62.

In this case, the monitoring of web breaks can occur at a point S1" in the area of the suction roll 78, for example. In this area, the material web 12 is exposed subsequent to lifting off the wire 72 and prior to the intake of the wire 80. Thus, the respective sensor 46 can be directed directly at the material web 12.

Alternatively or additionally, a monitoring of web breaks can also occur at a point S2" in the area of the exit 82 of the wire 80 from the support roll 62. In this area, the material web 12 supported by the wire 80 is exposed as well, so that a respective sensor 46 can again be directed directly at the material web 12.

As in the embodiment according to FIG. 2, the monitoring of web breaks can occur here, for example, again in a way described in connection with the embodiment according to FIG. 1, for example. Here as well, the monitoring of web breaks device 46 and/or the deactivation device can include at least one electronic control 49. In addition to the deactivation of the impingement dryer 64, the pickup roll 74 in particular can simultaneously be lifted off the press felt 22 when a web break is detected.

All embodiments therefore ensure that damages to the drying wires are practically eliminated in case of a web break, although one or more impingement dryers are used here.

For example, a monitoring of web breaks of the paper web is possible directly after the impingement drying, as shown. Such a web break detection, preferably over the entire width, does not only cause a lifting off of the pickup roll and/or a striking off of the paper, it simultaneously switches the impingement hood to web break operational mode, which, in particular, means that an internal circulation of the hot air is switched on, the burner is switched to minimal capacity, and/or the hood is transferred to a transfer position. A monitoring of web breaks over the entire width of the web also detects when only parts of the web are missing, thus avoiding a partial overheating of the drying wire.

It is also conceivable to monitor only the web edges of the guidance and/or driving side.

The monitoring can occur by various sensors with, in particular, optical sensors being used, in order to perform a monitoring by color recognition. A possible position for monitoring is directly after the impingement hood, for example, with a respective sensor being directed directly at the paper web still positioned on the drying wire, for example, at the time when the web is positioned on the drying wire of the subsequent suction roll or "DuoStabi-roll." However, it is also conceivable, for the sensor to be directed towards the first cylinder after the impingement dryer, in particular, when a group exchange occurs at this cylinder. Such a group exchange results in a point at which the paper web is exposed after the previous web has been lifted off and before the new web has run into the cylinder.

However, the respective web break detection is also possible by monitoring the vacuum of the first suctioned roll after the impingement dryer. As soon as the roll is no longer covered by paper, the vacuum reduces considerably. The suctioned roll monitored in this manner can therefore be a suction roll or a so-called "DuoStabi-roll" and it is useful for it to be provided inside of the first group of cylinders after the impingement dryer, preferably before the detachment doctor.

The monitored roll can also be one of the large suctioned rolls of the impingement dryer, for example, several of these large, suctioned rolls can be correspondingly monitored.

The web break detection can also be combined with an impingement dryer between the press section and a cylinder drying section or with an impingement dryer inside of the drying section.

The impingement dryer can be provided in a rather straight line or on a large, preferably suctioned roll. Basically, any combination of several of the one and/or other variants shown are conceivable.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

10 Drying section
12 Material web
14 Press nip
16 Press section
18 Impingement dryer
18' Impingement dryer
20 Pickup suction roll
22 Press felt
24 Wire
26 Larger support roll
26' Larger support roll
28 Impingement hood
28' Two-part impingement hood

30 Wire
32 Suction box
32' Suction box
34 Deflection roll
36 Suction roll
38 Wire
40 Multi-cylinder group, cylinder drying section
41 Intake
42 Exit
44 Cellar
46 Sensor
48 Roll
52 Run-off
54 Drying cylinder
56 Wire
58 Exposed web section
60 straight or slightly bent impingement line
61 Impingement dryer
61' Impingement hood
62 Larger support roll
64 Impingement dryer
64' Two-part impingement hood
66 Drying group
68 Drying cylinder
70 Wire
72 Wire
74 Pickup roll
76 Pickup roll
78 Suction roll
80 Wire
82 Run-off
L Web travel direction
S1–S3 Monitoring point
S1'–S4' Monitoring point
S1"–S2" Monitoring point

What is claimed:

1. A process for monitoring web breaks in a machine for producing a material web that includes at least one impingement dryer, said process comprising:

guiding the material web through the at least one impingement dryer;

monitoring the material web for web breaks in at least one of a region, viewed in a web travel direction, before an intake into the at least one impingement dryer, after an exit from the at least one impingement dryer and within the at least one impingement dryer; and at least partially deactivating the at least one impingement dryer when a web break is detected.

2. The process in accordance with claim 1, wherein the material web comprises one of a paper and cardboard web.

3. The process in accordance with claim 1, wherein the at least one impingement dryer includes a plurality of impingement dryers, and the monitoring for web breaks occurs at least one of before an intake into one of the plurality of impingement dryers, directly after the exit from the one of the plurality of impingement dryers, and between successively arranged impingement dryers.

4. The process in accordance with claim 1, wherein the monitoring for web breaks occurs at least essentially over an entire width of the material web.

5. The process in accordance with claim 1, wherein the monitoring for web breaks occurs along at least one lateral edge of the material web.

6. The process in accordance with claim 5, wherein monitoring for web breaks occurs only along one edge of the material web.

7. The process in accordance with claim 5, wherein monitoring for web breaks occurs along both lateral edges of the material web.

8. The process in accordance with claim 1, wherein at least one impingement dryer comprises at least one impingement hood, and, when a web break is detected, the at least one impingement hood is deactivated.

9. A process for monitoring web breaks in a machine for producing a material web that includes at least one impingement dryer, said process comprising:

guiding the material web through the at least one impingement dryer:

monitoring the material web for web breaks in at least one of a region, viewed in a web travel direction, before an intake into the at least one impingement dryer, after an exit from the at least one impingement dryer and within the at least one impingement dryer; and at least partially deactivating the at least one impingement dryer when a web break is detected, wherein at least one impingement dryer comprises at least one impingement hood, and, when a web break is detected, the at least one impingement hood is deactivated, and wherein the deactivation of the at least one impingement hood comprises reversing operational states of the at least one impingement hood from a normal operational state, in which the material web is impinged with at least one of hot air and hot steam, to a web break operational state, in which the material web is impinged with at least one of hood-internal hot air and hot steam impingement.

10. The process in accordance with claim 9, wherein, in the web break operational state, the material web is impinged with only at least one of hood-internal hot air and hot steam.

11. A process for monitoring web breaks in a machine for producing a material web that includes at least one impingement dryer, said process comprising:

guiding the material web through the at least one impingement dryer; monitoring the material web for web breaks in at least one of a region, viewed in a web travel direction, before an intake into the at least one impingement dryer, after an exit from the at least one impingement dryer and within the at least one impingement dryer; and at least partially deactivating the at least one impingement dryer when a web break is detected, wherein at least one impingement dryer comprises at least one impingement hood, and, when a web break is detected, the at least one impingement hood is deactivated, and wherein the at least one impingement hood is deactivated by switching a burner assigned to the at least one impingement hood to minimum capacity.

12. The process in accordance with claim 8, wherein the at least one impingement hood is deactivated by transferring the hood from a normal web travel line into a web transfer position.

13. The process in accordance with claim 1, wherein the at least one impingement dryer is deactivated within about 20 seconds after the web break.

14. The process in accordance with claim 13, wherein the at least one impingement dryer is deactivated within about 10 seconds after the web break.

15. The process in accordance with claim 1, wherein, when a web break is detected, the process further comprises opening at least one pickup point located before the at least one impingement dryer.

16. The process in accordance with claim 1, wherein, when a web break is detected, the process further comprises opening at least one pickup point is located at least one of before and in a press section.

17. The process in accordance with claim 1, wherein, when a web break is detected, the process further comprises simultaneously striking off the material web.

18. The process in accordance with claim 1, wherein monitoring of the material web for web breaks comprises positioning a sensor at least at one point and detecting a passing of the material web with the at least one sensor.

19. A process for monitoring web breaks in a machine for producing a material web that includes at least one impingement dryer, said process comprising:

guiding the material web through the at least one impingement dryer;

monitoring the material web for web breaks in at least one of a region, viewed in a web travel direction, before an intake into the at least one impingement dryer, after an exit from the at least one impingement dryer and within the at least one impingement dryer; and at least partially deactivating the at least one impingement dryer when a web break is detected, wherein the monitoring of the material web for web breaks comprises at least one of monitoring the material web with at least one optical sensor and at least one camera.

20. The process in accordance with claim 19, wherein the web break is detected by color recognition.

21. The process in accordance with claim 19, wherein the web break is detected by image evaluation.

22. The process in accordance with claim 1, wherein the at least one impingement dryer comprises at least one impingement hood, and at least one sensor is directed towards the material web at a location directly after the at least one impingement hood.

23. The process in accordance with claim 22, wherein a drying wire is arranged to guide the material web through the at least one impingement dryer, and the at least one sensor is directed toward a region of the material web which is positioned on the drying wire.

24. The process in accordance with claim 22, wherein a drying wire is arranged to guide the material web through the at least one impingement dryer and over a suctioned roll positioned after the at least one impingement dryer, and the at least one sensor is directed toward a region of the material web which is positioned on the drying wire where it is guided over the suctioned roll.

25. The process in accordance with claim 22, wherein the machine includes a first drying wire and a second drying wire, and a drying cylinder is arranged after the at least one impingement dryer to transfer the material web from the first drying wire to the second drying wire, and the at least one sensor is directed toward a location where the material web is supported by the drying cylinder and between the first and second drying wires.

26. A process for monitoring web breaks in a machine for producing a material web that includes at least one impingement dryer, said process comprising:

guiding the material web through the at least one impingement dryer;

monitoring the material web for web breaks in at least one of a region, viewed in a web travel direction, before an intake into the at least one impingement dryer, after an exit from the at least one impingement dryer and within the at least one impingement dryer; and at least partially deactivating the at least one impingement dryer when a web break is detected, wherein the at least one impingement dryer comprises a suctioned roll and a suction roll is arranged after the at least one impingement dryer, and the web breaks are monitored by monitoring a vacuum of at least one of the suctioned roll and the suction roll.

27. The process in accordance with claim 26, wherein the suction roll is located in a first cylinder group located after the at least one impingement dryer.

28. The process in accordance with claim 26, wherein the suction roll is located before a detachment doctor.

29. The process in accordance with claim 1, wherein the machine includes a press section and a cylinder drying section, and the monitoring for web breaks occurs in a region of the at least one impingement dryer positioned between the press section and the cylinder drying section.

30. The process in accordance with claim 1, wherein the machine includes a cylinder drying section, and the monitoring for web breaks occurs in a region of the at least one impingement dryer located in the cylinder drying section.

31. The process in accordance with claim 1, wherein the at least one impingement dryer comprises a guide path, which is at least one of a straight and slightly bent, on which the material web is at least partially guided, and the monitoring for web breaks occurs in a region of the at least one impingement dryer.

32. The process in accordance with claim 31, wherein the machine includes another impingement dryer comprising a suctioned support roll, and the monitoring for web breaks further occurs in a region of the suctioned support roll.

33. The process in accordance with claim 1, wherein the machine includes another impingement dryer comprising a suctioned support roll, and the monitoring for web breaks occurs in a region of the suctioned support roll.

* * * * *